US006141526A

United States Patent [19]

Ikeda

[11] Patent Number: 6,141,526

[45] Date of Patent: Oct. 31, 2000

[54] COLOR PRINTER BELT MEANDER CONTROL METHOD AND APPARATUS

[75] Inventor: Teruyuki Ikeda, Niigata, Japan

[73] Assignee: NEC Corporation, Tokyo, Japan

[21] Appl. No.: 09/413,944

[22] Filed: Oct. 7, 1999

[30] Foreign Application Priority Data

Oct. 12, 1998 [JP] Japan ..... 10-303208

[51] Int. Cl.[7] ..... G03G 15/00

[52] U.S. Cl. ..... 399/395; 399/162; 399/165

[58] Field of Search ..... 198/806, 807, 198/814; 347/116; 399/49, 66, 72, 160, 162, 165, 303, 390, 394, 395, 388; 271/227, 261

[56] References Cited

U.S. PATENT DOCUMENTS

| | | | |
|---|---|---|---|
| 4,961,089 | 10/1990 | Jamzadeh | 399/165 |
| 5,896,979 | 4/1999 | Hokari et al. | 198/807 |
| 5,995,802 | 11/1999 | Mori et al. | 399/394 |

FOREIGN PATENT DOCUMENTS

| | | |
|---|---|---|
| 57-160651 | 10/1982 | Japan . |
| 4-29182 | 1/1992 | Japan . |
| 4-201935 | 7/1992 | Japan . |
| 5-155457 | 6/1993 | Japan . |
| 6-83127 | 3/1994 | Japan . |
| 7-225543 | 8/1995 | Japan . |
| 9-222827 | 8/1997 | Japan . |
| 10-231041 | 9/1997 | Japan . |
| 9-222827 | 9/1997 | Japan . |
| 9-330005 | 12/1997 | Japan . |

*Primary Examiner*—Arthur T. Grimley
*Assistant Examiner*—Hoang Ngo
*Attorney, Agent, or Firm*—Ostrolenk, Faber, Gerb & Soffen, LLP

[57] ABSTRACT

The present invention provides a color printer belt meander control method. Starting at a predetermined position of a belt, the belt edge is detected for each small interval of the endless belt. Using a difference between the belt edge position data for the first time and the second time, all skew amounts are calculated. From the skew amounts, a skew correction amount is calculated for each interval. The corrected belt edge position data which has been corrected by the skew correction amount is used to calculate an average belt edge position of the entire belt. The difference between this average belt edge position and a desired belt edge position data is deleted from the corrected belt edge position data. The belt edge position data for small intervals is offset corrected so as to obtain a belt edge learning value. According to the belt edge learning value and the belt edge position data, drive of the steering mechanism is controlled.

17 Claims, 13 Drawing Sheets

COLOR PRINTER BELT MEANDER CONTROL METHOD AND APPARATUS

BACKGROUND OF THE INVENTION

1. Field of the Invention

The present invention relates to meandering (snaking) of a photo-sensitive belt (including a transfer belt) on which Yellow (Y), Magenta (M), Cyan (C), and Black (BK) intermediate images are overlapped before transferred to a recording medium in a laser color printer.

2. Description of the Related Art

The laser color printer may be such that four color developing units are switched from one to another by a mechanical drive unit, so as to be brought into contact with a photosensitive drum. More specifically, the four color toner images are formed while the photosensitive drum makes four turns. In contrast to this, as shown in FIG. 7, there is a printer where four of photosensitive drums 501 are aligned for the four colors. That is, for each of the colors, an electrostatic latent image is formed by an exposure unit 502, and then a toner image is formed on the photosensitive drum 501 using the respective development units 503. The toner image is transferred onto a recording medium 505 by operating a transfer roller 506 matched with the feed of the recording medium 505 traveling on the paper feed path 504. The image is finally fixed by a thermal roller 507 and a pressurizing roller 508. This method is called tandem type.

As shown in FIG. 8, the tandem type may be such that along the photosensitive belt, there are arranged exposure units 602 such as laser and development units 603 of four colors, so that the electrostatic latent image formed on the photosensitive belt 601 is covered with toner. The obtained toner image is transferred to the recording medium 605 by operating the transfer roller 606 traveling along a paper feed path 604. The image is finally fixed by a thermal roller 607 and a pressurizing roller 608.

There is also a composite type printer of FIG. 7 and FIG. 8. That is, the toner image on the photosensitive drum 501 is not transferred directly to the recording medium 505 but transferred to an intermediate medium, i.e., a transfer belt.

The most important thing about a color printer performance is that the toner images of four colors should be obtained with a high resolution, i.e., with allowance of ½ of the dot size or below. In the aforementioned photosensitive drum method, the paper feed accuracy affects this resolution, and in the photosensitive belt method, the photosensitive belt traveling accuracy affects the resolution. Moreover, in the composite type transfer belt, the transfer belt traveling accuracy affects the resolution.

Since the present invention intends to increase accuracy in the photosensitive belt type color printer, hereinafter, explanation will be given on conventional problems in the belt type.

As shown in FIG. 9, in the photosensitive belt type, a photosensitive belt 701 is driven by a drive roller 702 and supported by a plurality of auxiliary rollers 703. Here, it is necessary to prevent skew, i.e., belt width direction deviation caused by the difference in length of both edges of the photosensitive belt 701 and deviation in mechanical parallelism of the auxiliary rollers 703. (It should be noted that transfer belt has identical drive configuration as the photosensitive belt and its explanation will be omitted.)

A steering roller 704 is supported in such a manner that the angle can be changed by a steering arm 705. The steering roller is provided with a cam 708 and a return spring 709 so that its inclination can be changed around the designed mechanical parallelism as a center by a pulse motor 707 via a reduction gear 706.

A belt edge sensor 710 provided so as to sandwich the photosensitive belt monitors whether the photosensitive belt 701 is traveling along predetermined position of the rollers. That is, if the belt edge sensor has detected that the photosensitive belt 701 deviates in one direction, the steering roller 704 is inclined so that the photosensitive belt 701 is moved in the opposite direction. Thus, the belt is rotated along a predetermined path.

However, such a configuration has problems as follows. Since the belt edge sensor 710 and the steering roller 704 are provided apart from each other, there is a time delay between them. When the belt edge sensor 710 decides that the deviation has become zero, the steering roller 704 has already inclined in the opposite direction. Since this occurs repeatedly, there arises a meander of the photosensitive belt around its rotation center. The photosensitive belt is stable around the drive roller 702 and deviates most at the steering roller.

Here, even if the meander arises in the photosensitive belt 701, if only one image (for example one A4 sheet) is formed within one meander cycle, the timing can be obtained by the belt edge and there is not danger of dot position shift between the four colors. That is, performance as the printer is allowable.

Actually, however, there is a case when a plurality of images are formed for each of the colors on the photosensitive belt 701. In this case, there is a danger of meander direction change between the colors.

Accordingly, when viewed in the main scan direction, the image is matched at the start point but the end portion is shifted by the meander.

In the aforementioned printer apparatus using the steering mechanism and the photosensitive belt, a positional shift up to 100 to 200 micrometers occurs. The belt is dedicated for transfer function so as to eliminate the limit of the belt holding mechanism. For example, an abutment guide is formed on the roller or the belt is provided with a guide protrusion, so that the belt is fed normally using a method other than the steering mechanism.

However, in order to apply this method to a photosensitive belt, there arise a problem that it is difficult to produce a seamless photosensitive belt, and a seam is indispensable, which results in a stepped portion.

In order to reduce the stepped portion, production costs should be significantly increased. Furthermore, because of the substrate material of the photosensitive belt, if the photosensitive belt is regulated by an abutment portion, the auxiliary roller cannot have an appropriate sliding.

The aforementioned problems of the conventional configuration using the steering roller can be summed up as follows.

The belt edge state detected by the belt edge sensor is used by the steering roller with a time delay. That is, the steering is controlled after detecting that the belt edge position is at a reference position, when the steering roller control is further performed. As a result, the belt inevitably meanders.

SUMMARY OF THE INVENTION

It is therefore an object of the present invention to provide a control method capable of minimizing the belt meander in the color printer having the belt edge sensor with a time delay and a steering roller.

The color printer belt meander control method according to the present invention is for detecting a belt edge position of a rotating endless belt and controlling a steering mechanism according to the belt edge position so as to suppress meandering of the rotating endless belt. More specifically, the rotating endless belt has a rotation reference position mark at which belt edge detection is started for each small interval and all the skew amounts are calculated according a difference between the belt edge position data at the rotation reference position mark for the first time and the belt edge position data at the rotation reference position mark for the second time. The method further comprises steps of: dividing the total of the skew amounts by the number of the small intervals so as to calculate a skew correction amount for each small interval; calculating an average belt edge position for one turn of the belt according to a corrected belt edge position data of each small interval which has been corrected according to the skew correction amount; calculating a difference between this average belt edge position and a target belt edge position data at the rotation reference position mark; deleting this difference from the corrected belt edge position data for each small interval to obtain a belt edge learning value; and controlling drive of the steering mechanism according to the belt edge learning value and the belt edge position data detected for each small interval.

According to another aspect of the present invention, the belt edge position is detected for each small interval with a predetermined sampling cycle and its average value is used as a belt edge position data.

According to still another aspect of the present invention, for an arbitrary small interval, a learning value deviation as a difference between the belt edge earning value and a detected belt edge position data is compared to a learning value deviation of a preceding mall interval, and according to the comparison result, the steering mechanism drive is controlled.

According to yet another aspect of the present invention, the belt edge learning value is calculated when the color printer is activated.

The color printer belt meander control apparatus according to the present invention comprises a steering control unit for detecting a belt edge position of a rotating endless belt and controlling a steering mechanism according to the belt edge position so as to suppress meandering of the rotating endless belt, wherein the rotating endless belt has a rotation reference position mark at which belt edge detection is started for each small interval and all the skew amounts are calculated according a difference between the belt edge position data at the rotation reference position mark for the first time and the belt edge position data at the rotation reference position mark for the second time, and the control unit further performs: dividing the total of the skew amounts by the number of the small intervals so as to calculate a skew correction amount for each small interval; calculating an average belt edge position for one turn of the belt according to a corrected belt edge position data of each small interval which has been corrected according to the skew correction amount; calculating a difference between this average belt edge position and a target belt edge position data at the rotation reference position mark: deleting this difference from the corrected belt edge position data for each small interval so as to obtain a belt edge learning value; and controlling drive of the steering mechanism according to the belt edge learning value and the belt edge position data detected for each small interval.

The control unit detects the belt edge position for each small interval with a predetermined sampling cycle and its average value is used as a belt edge position data.

For an arbitrary small interval, the control unit compares a learning value deviation as a difference between the belt edge learning value and a detected belt edge position data to a learning value deviation of a preceding small interval, and according to the comparison result, the control unit controls the steering mechanism drive.

The control unit performs belt edge learning value calculation upon reception of a color printer start signal.

According to another aspect of the invention, the control unit performs the belt edge learning value calculation upon reception of an initialization signal at start of the color printer.

DESCRIPTION OF THE PREFERRED EMBODIMENTS

Before starting explanation of the control method, explanation will be given on the belt configuration to be controlled by this control method and how the microcomputer used for this control is interfaced.

Figures 9, 9A:
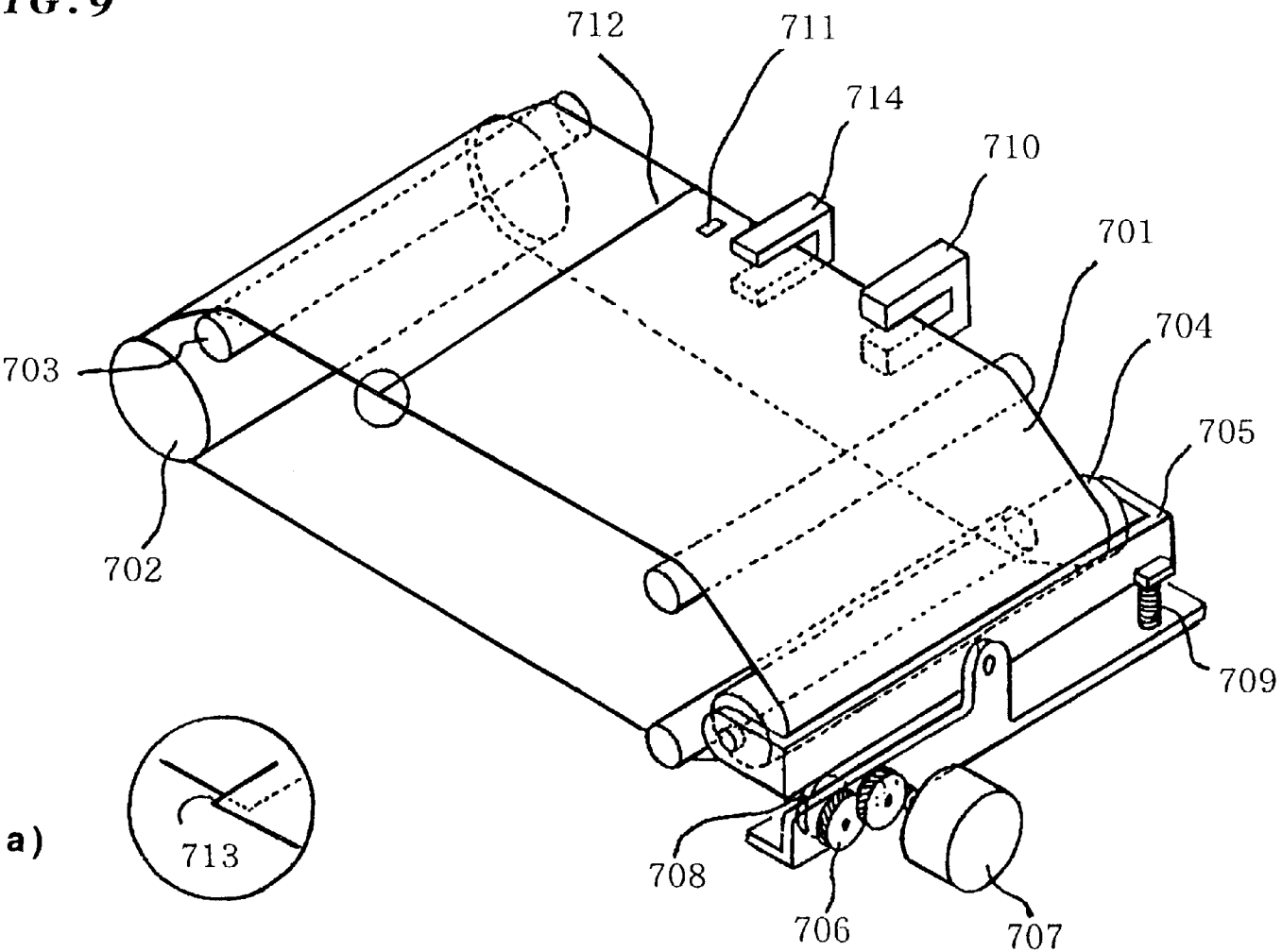
FIG. 9 is a perspective view of an essential portion of the laser color printer.

Firstly, the belt configuration will be explained on the conventional configuration of FIG. 9 as an object to be controlled.

The belt edge sensor 710 detects the edge position of the photosensitive belt 701 as a voltage change. The edge sensor includes LED or other light emitting element arranged under the photosensitive belt and a photodiode of 3 mm width and 10 mm length is arranged above the photosensitive belt (photosensitive body forming surface). Furthermore, the belt edge sensor includes an amplification circuit for amplifying the photodiode output.

Figure 10:
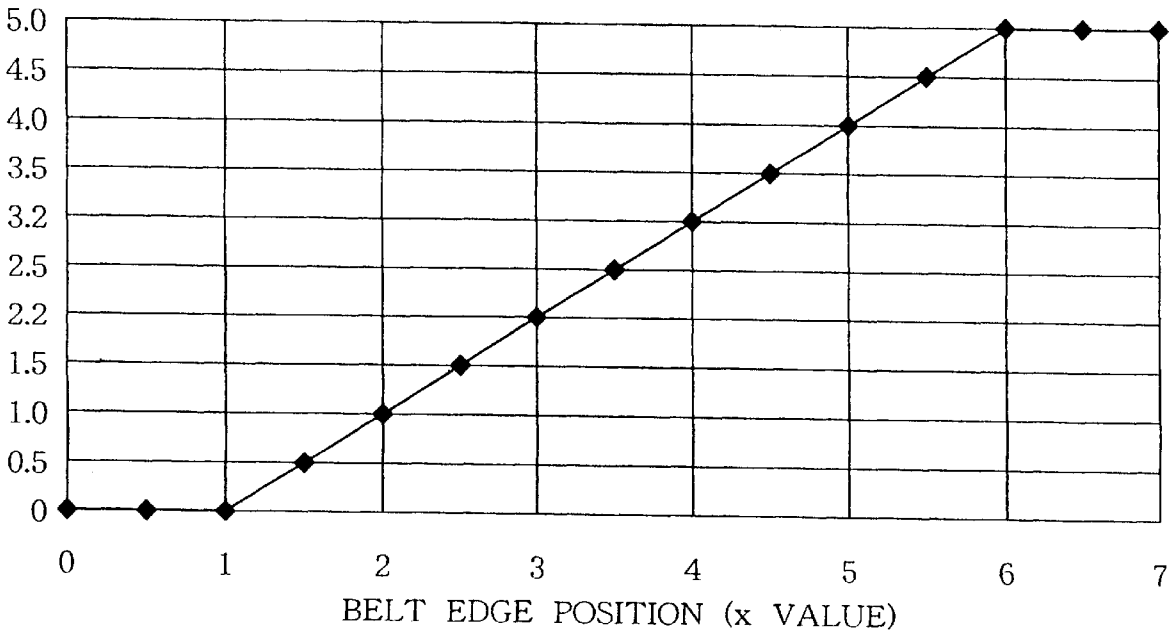
FIG. 10 shows a relationship between the output voltage and the belt edge position.
Figure 10A:
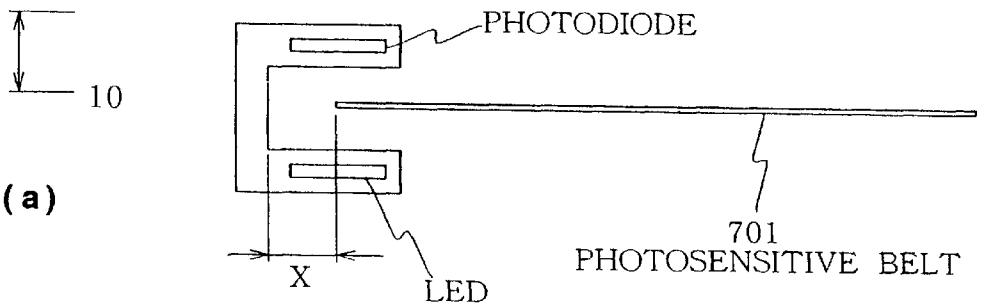

The output voltage from the photodiode is designed to change by the change of the light radiation area. As shown in FIG. 10, the output voltage is proportional to the light radiation area (i.e., belt edge position) of the LED defined by the edge position of the photosensitive belt 701.

On the other hand, the steering mechanism for changing the skew direction and skew amount of the photosensitive belt 701 has a configuration as follows. The steering arm 705 supports the steering roller 704 in such a manner that the steering roller can rotate. The steering arm is supported in such a manner that its inclination can be changed around the center of the photosensitive belt width direction, with respect to the mechanical parallel state (parallel to the drive roller 702 and other auxiliary rollers). The steering arm is provided with a cam 708 and a spring 709 so that the inclination can be obtained by rotation of the pulse motor 707 having a gear 708 or other speed reduction mechanism.

The pulse motor changing the inclination of the steering roller 704 detects using a photo-sensor (not depicted) an origin (not depicted) formed on the cam, so that the pulse increase or decrease for the origin changes the inclination of the steering roller 704.

Moreover, the pulse motor 707 is driven via a motor driver according to a signal from the microcomputer. In this embodiment, one pulse of the pulse motor 707 inclines the steering roller by 0.006 degrees.

Furthermore, the photosensitive belt 701 has a rotation reference detection hole (hereinafter, referred to as TOF) as a rotation reference position mark. Moreover, the photosensitive belt has a seam 712. The photosensitive belt is prepared by cutting a photosensitive sheet into a photosensitive belt and melting the both ends to be connected. Accordingly, the melted seam has a stepped portion in an enlarged view.

The TOF 711 of the photosensitive belt is detected by a transmission type photo-sensor 714. This photo-sensor is connected to the microcomputer for performing belt meander control.

Figure 1:
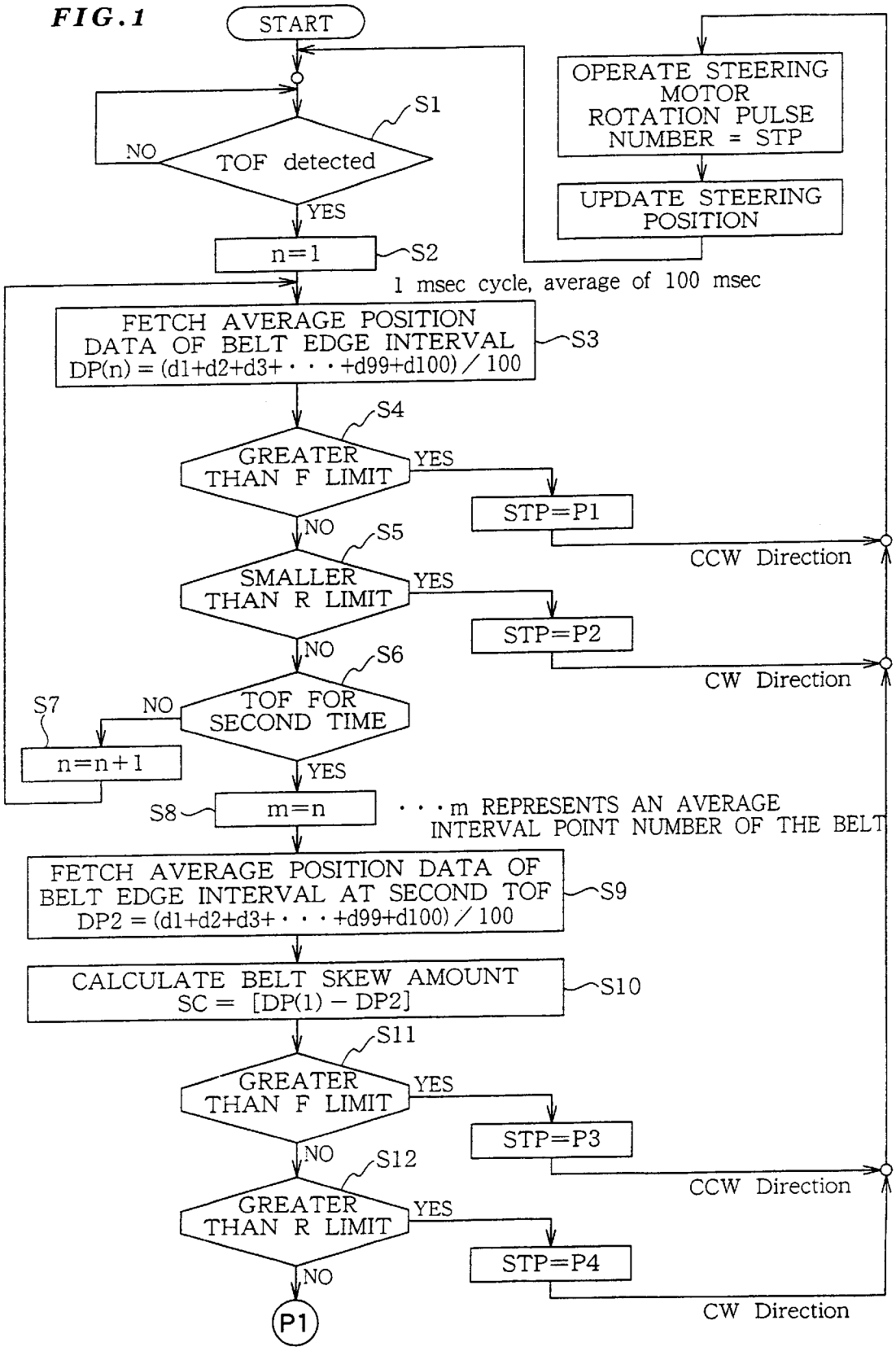
FIG. 1 is a flowchart of belt meander learning processing according to an embodiment of the present invention.
Figure 2:
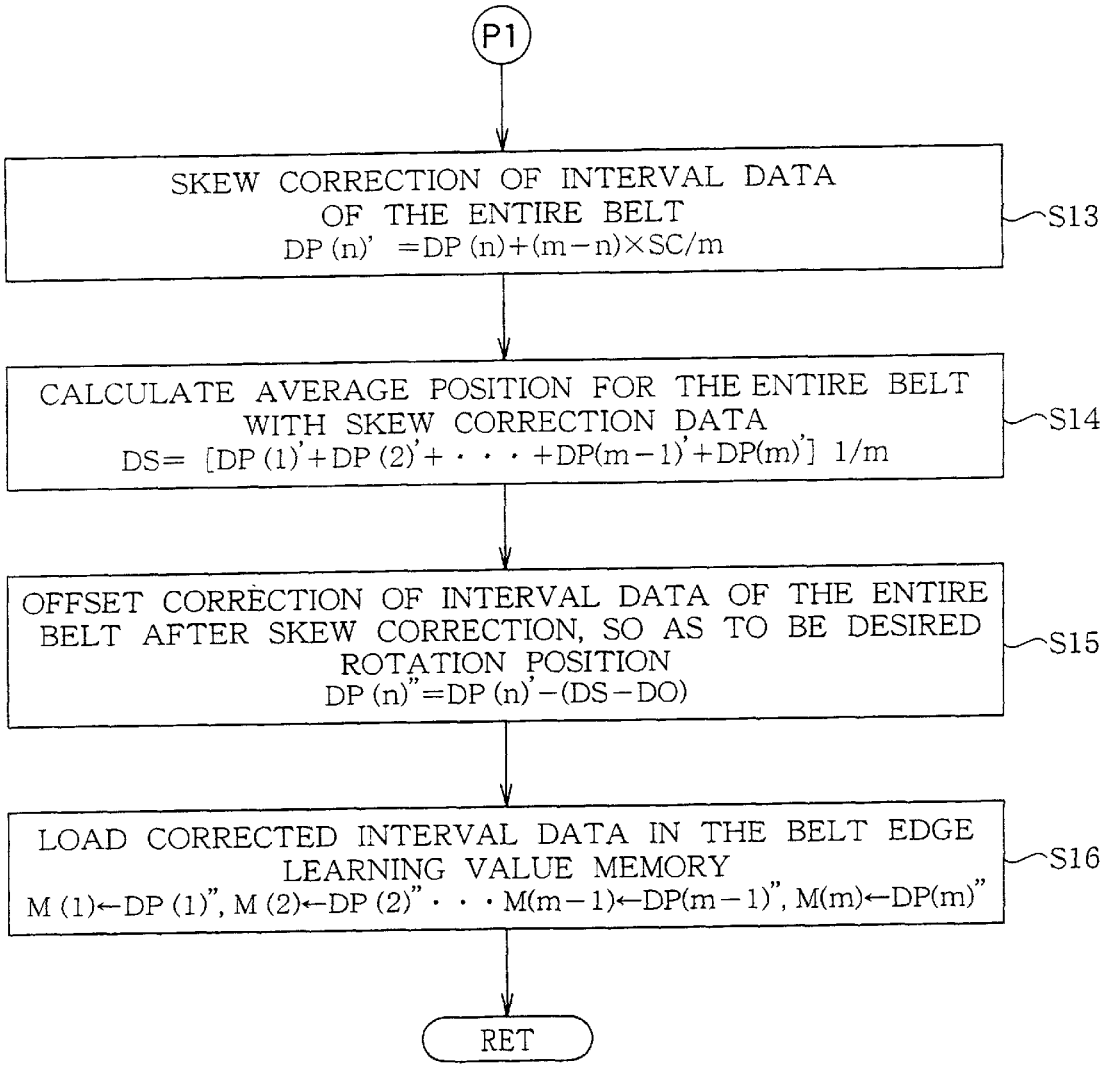
FIG. 2 is a flowchart as a continuance of the belt meander learning processing shown in FIG. 1.
Figure 3:
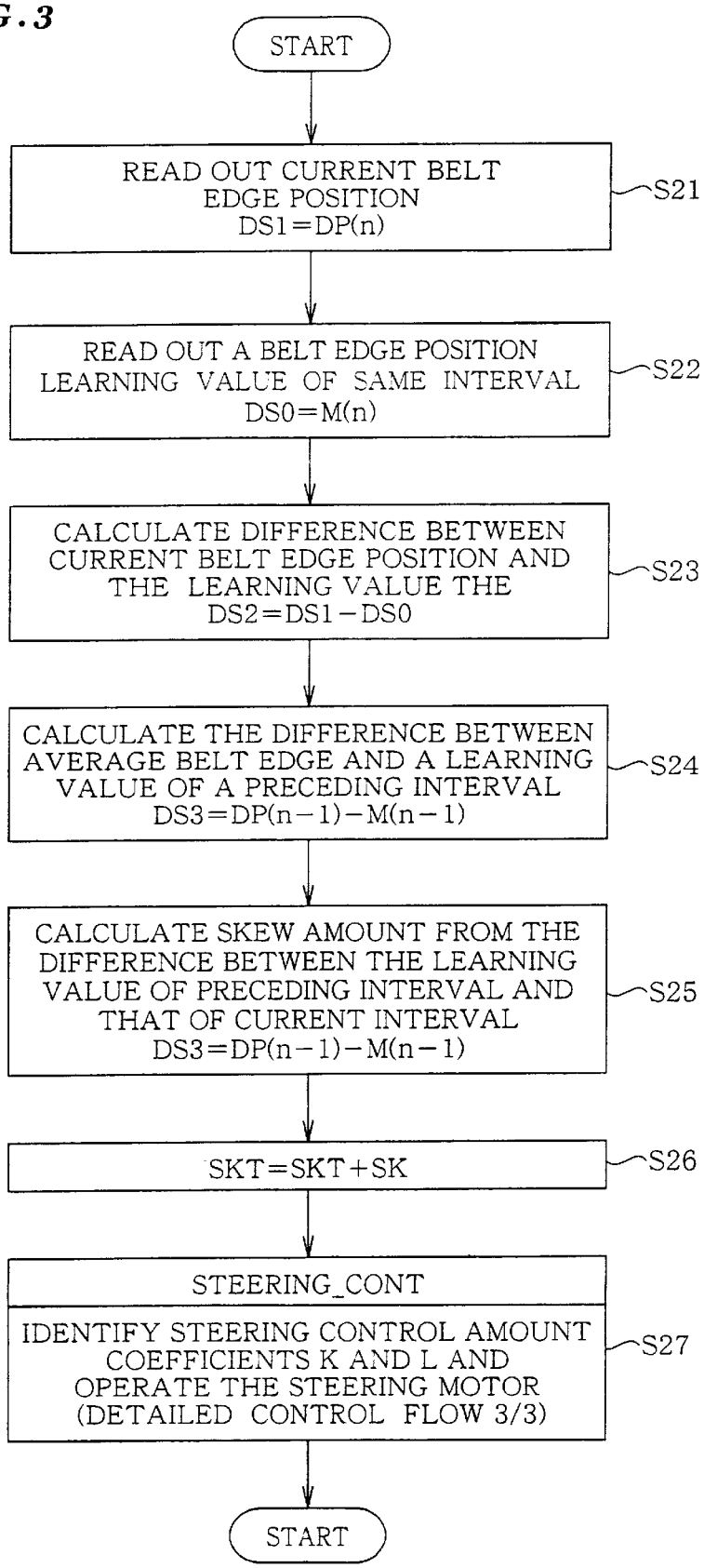
FIG. 3 is a flowchart of steering control for belt meander control according to the embodiment of the present invention.
Figure 4A:
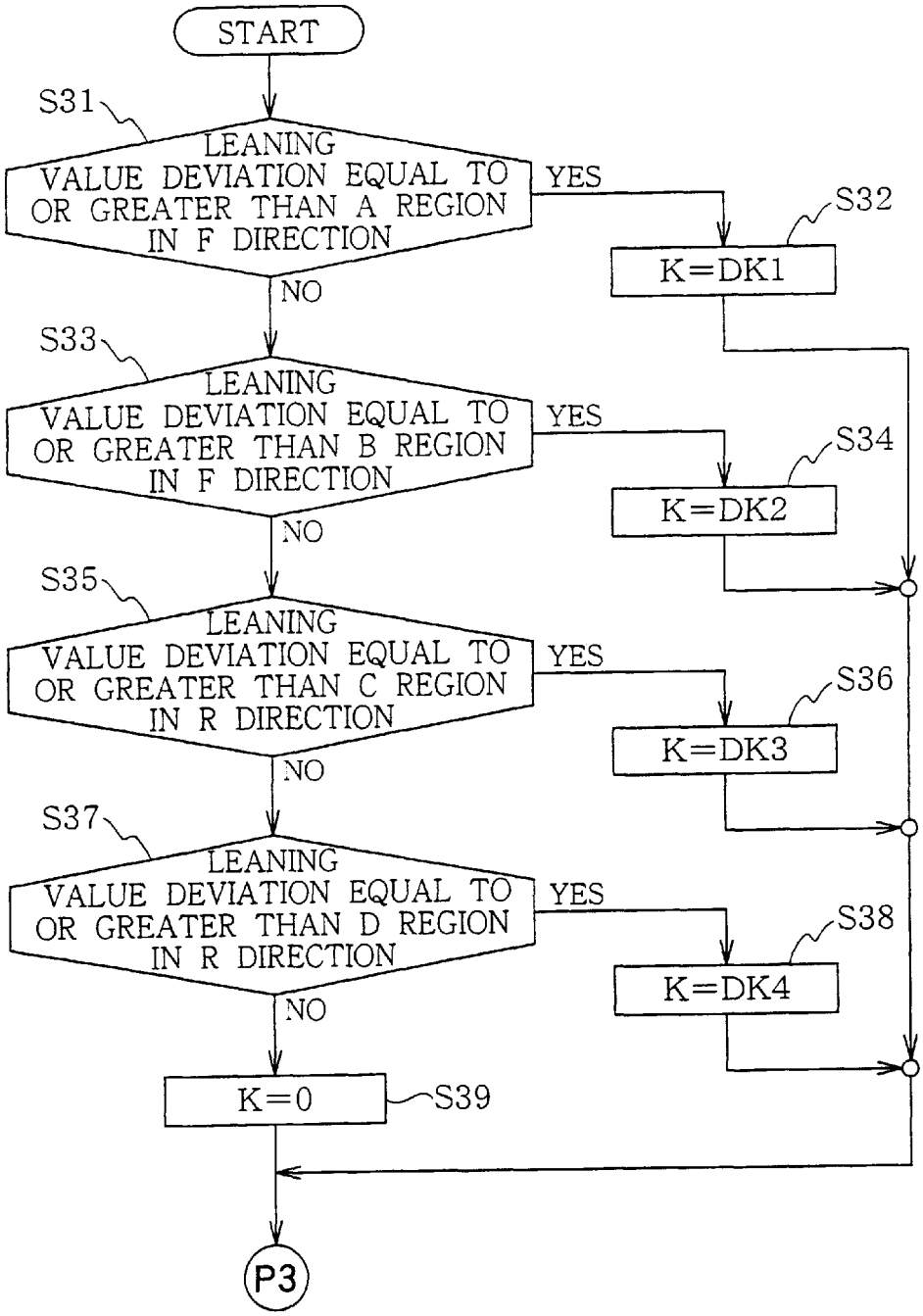
FIG. 4(A) is first part of flowchart for controlling a steering amount according to the embodiment of the present invention.
Figure 4B:
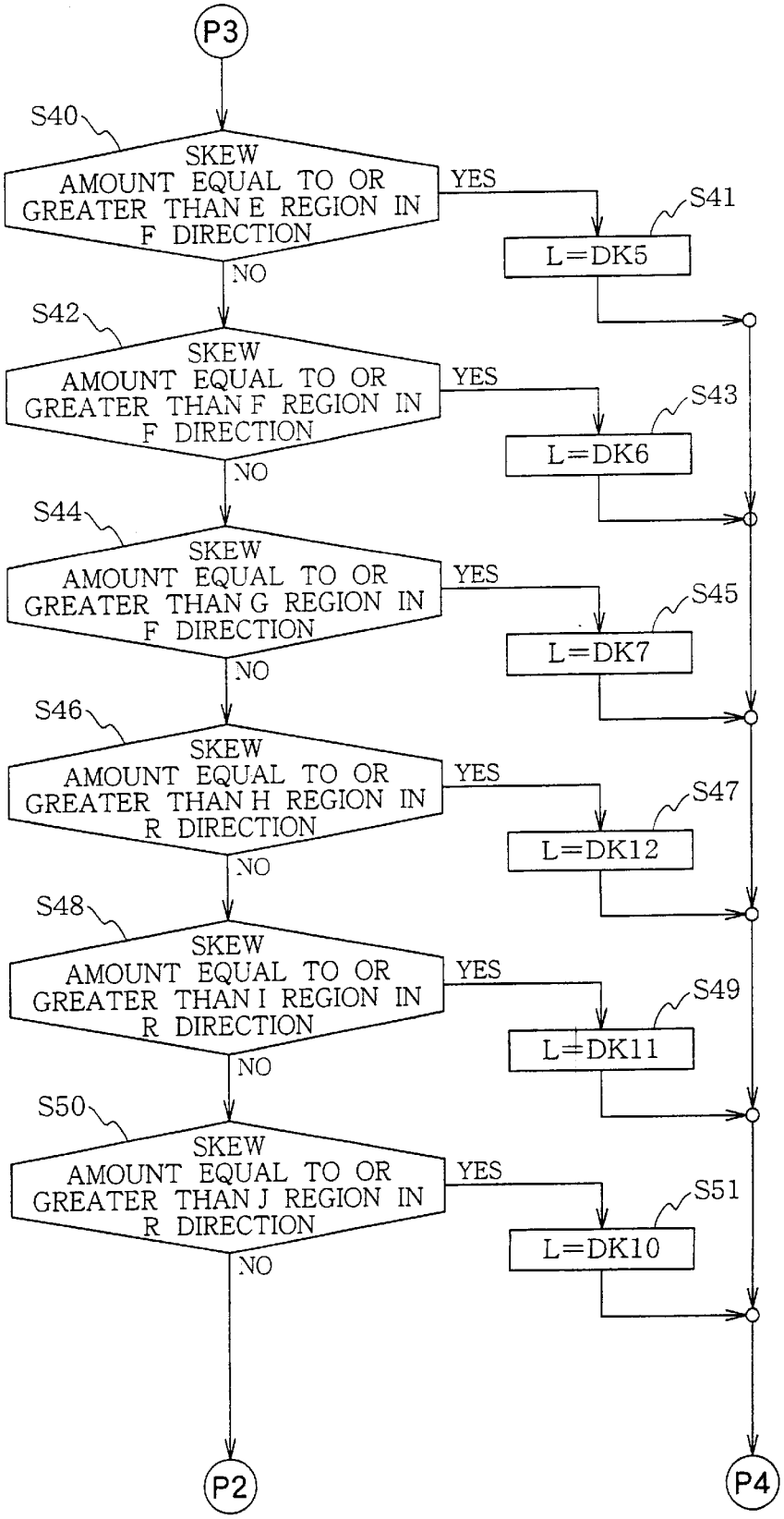
FIG. 4(B) is second part of flowchart for controlling a steering amount according to the embodiment of the present invention.
Figure 4C:
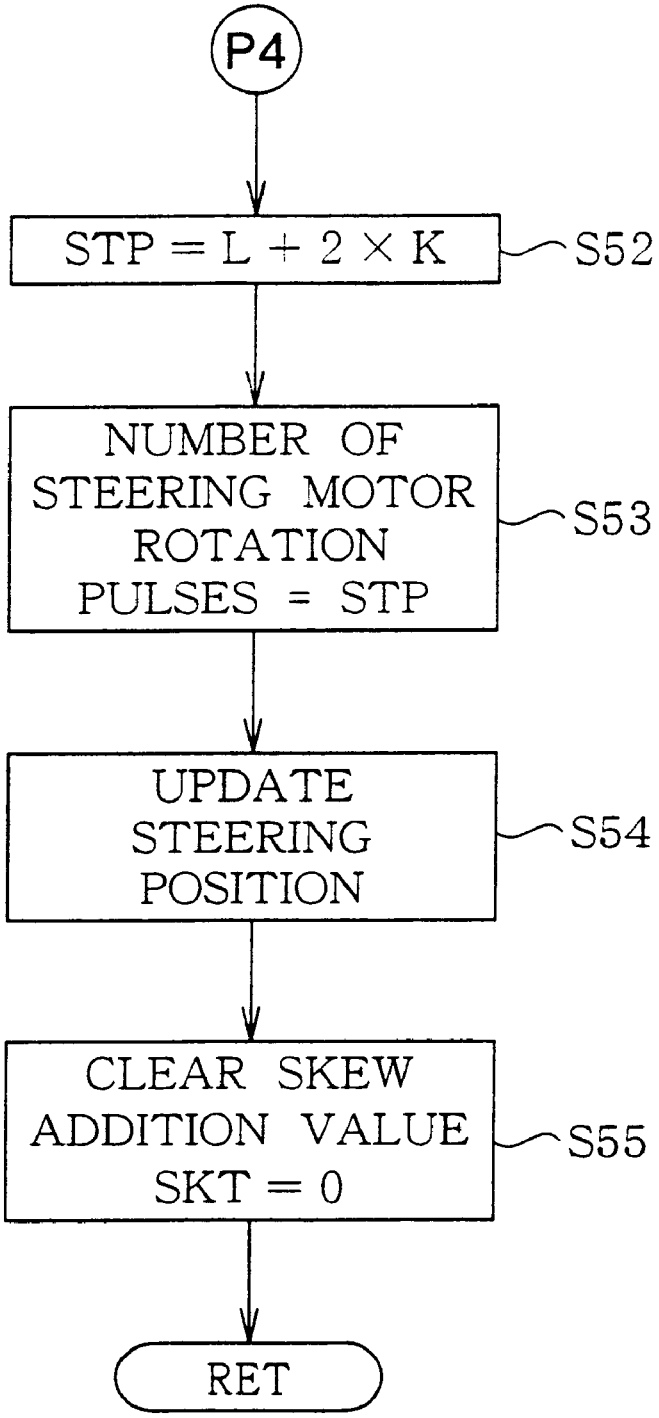
FIG. 4(C) is third part of flowchart for controlling a steering amount according to the embodiment of the present invention.
Figure 5:
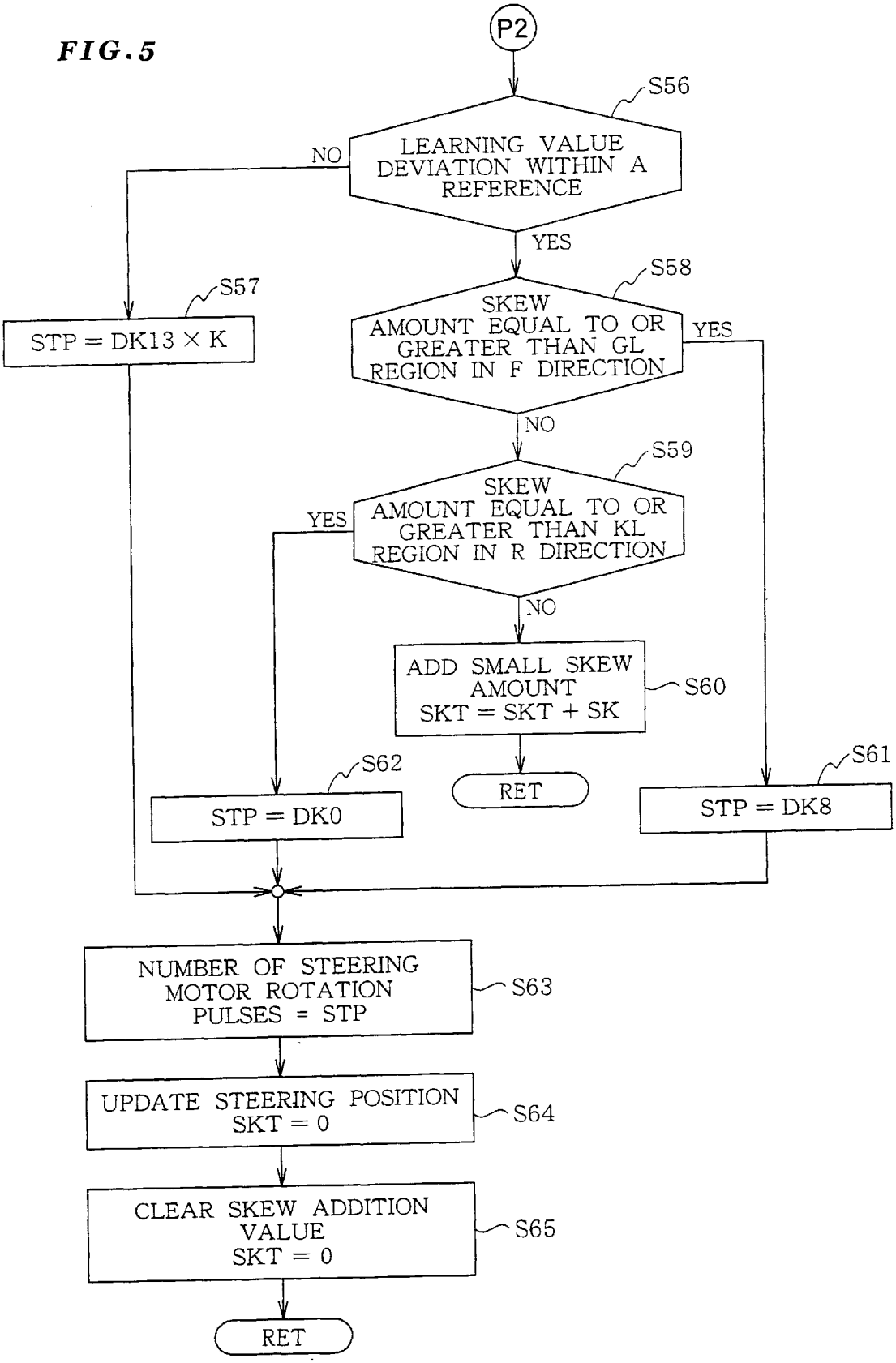
FIG. 5 is a flowchart as a continuance of the steering amount control flowchart of FIG. 4(B).
Figure 6A:
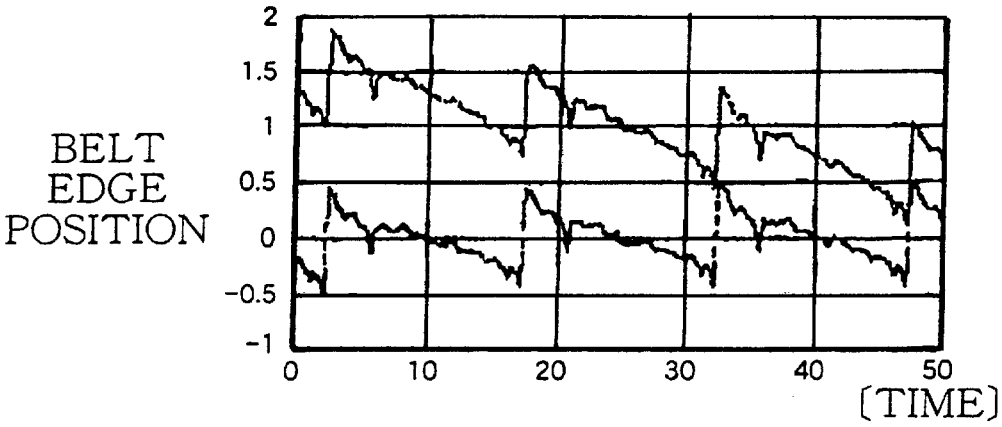
FIG. 6 shows a deviation of the belt edge inherent fluctuation against the learning value and a skew generation state.
Figure 6B:
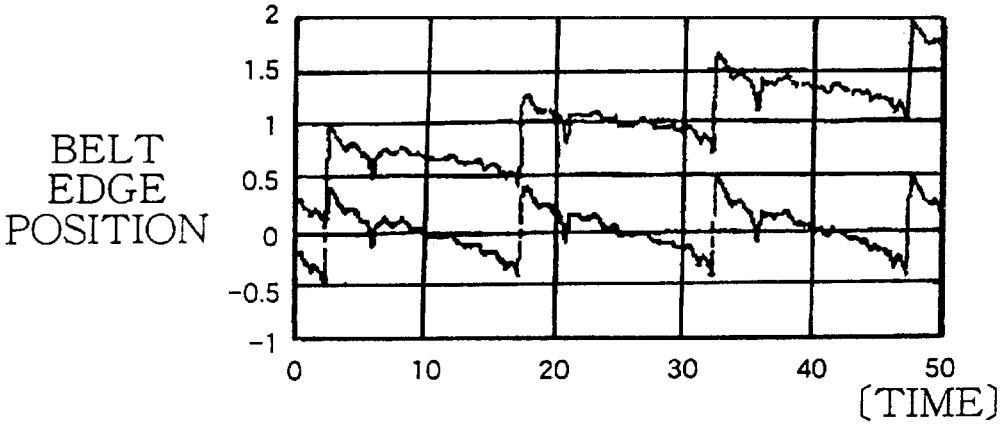
Figure 6C:
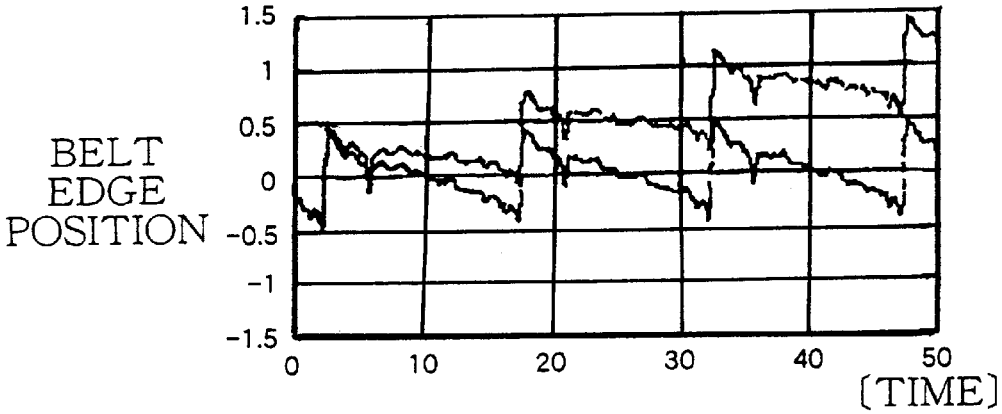
Figure 6D:
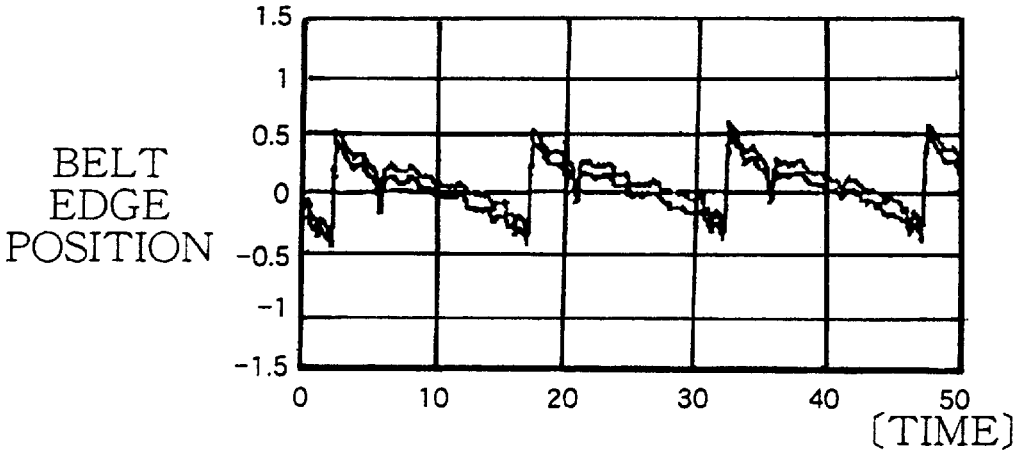
Figure 6E:
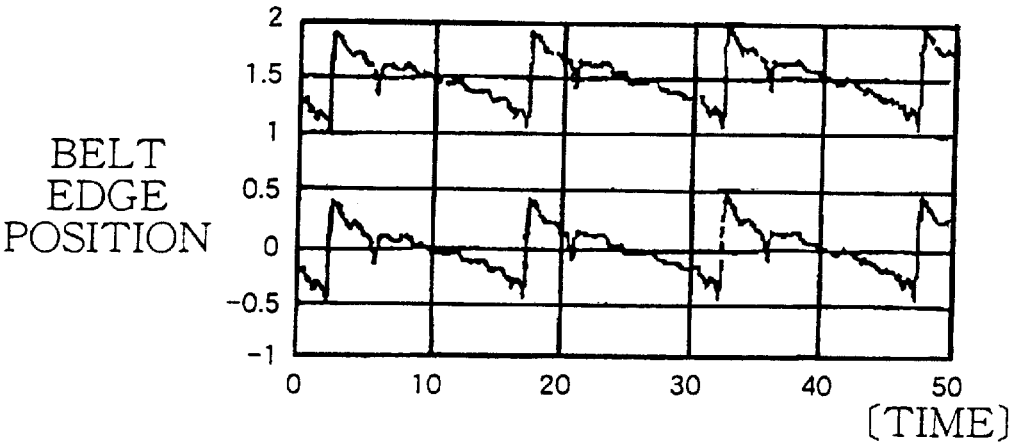
Figure 7:
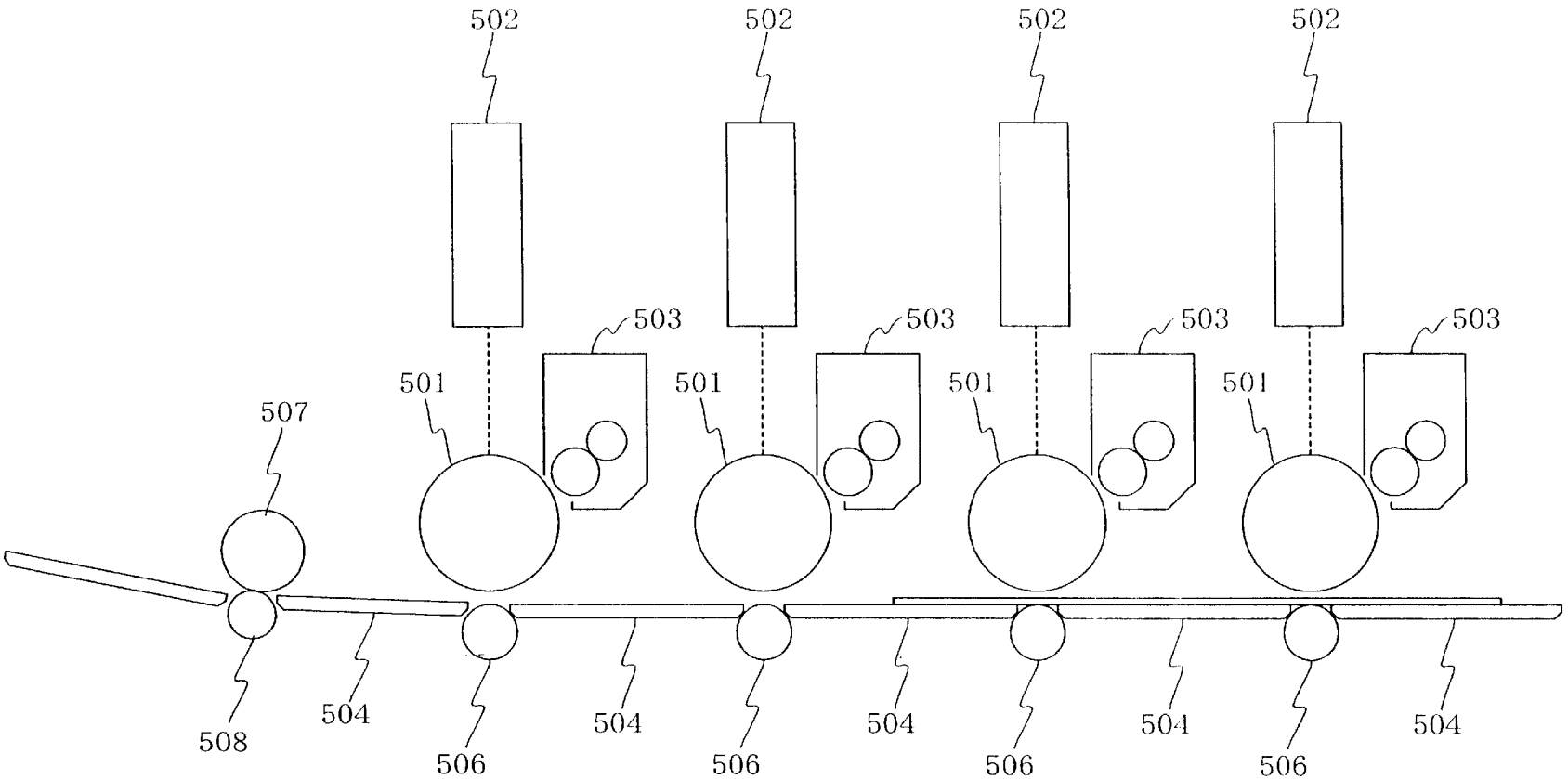
FIG. 7 schematically shows a configuration example of a laser color printer.
Figure 8:
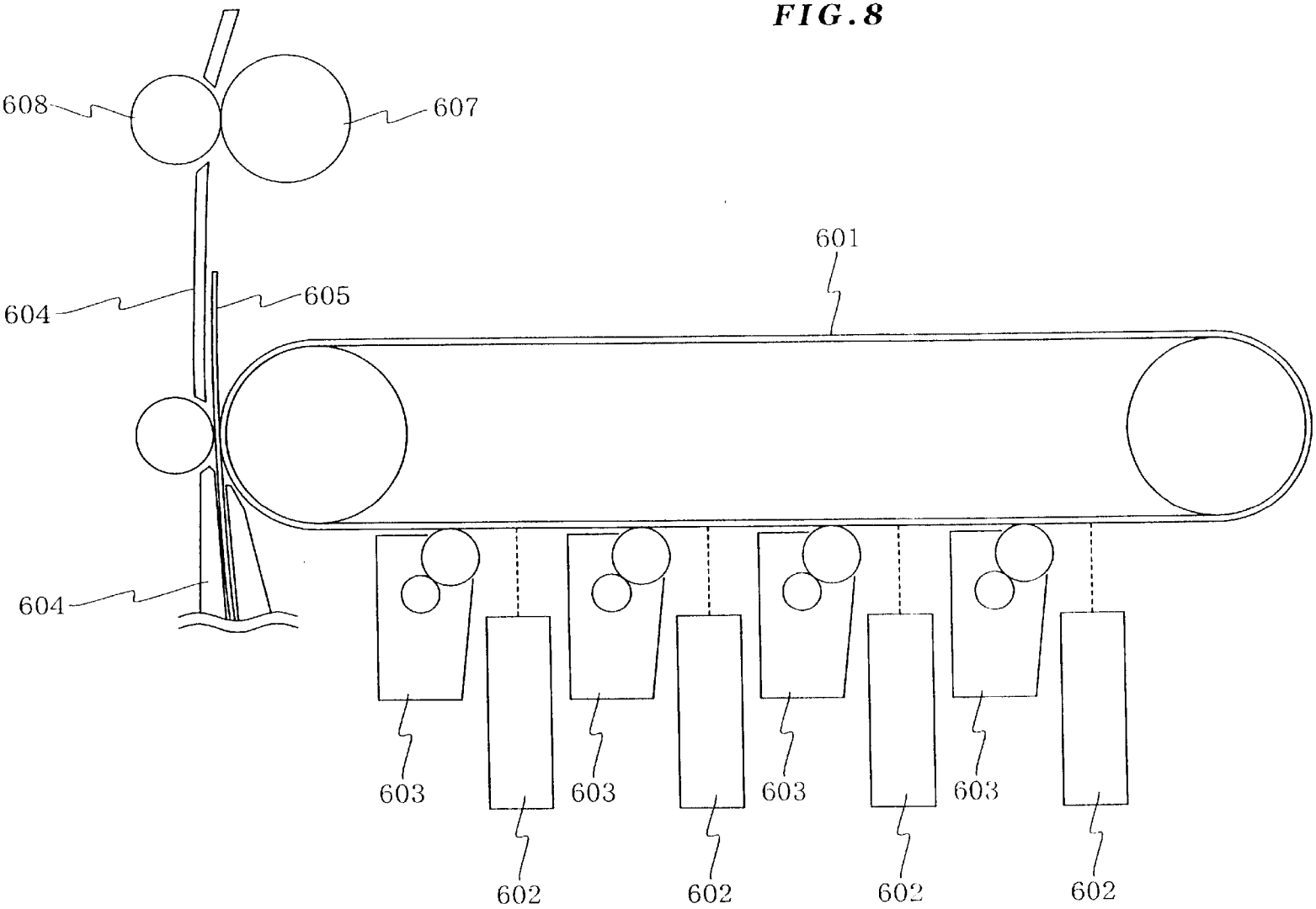
FIG. 8 schematically shows another configuration example of a laser color printer.

FIG. 1, FIG. 2, and FIG. 3 are control flowcharts constituting a kernel portion of the belt meander control method according to the present embodiment.

The control is constituted by two main parts. Here, FIG. 1 and FIG. 2 shows an initializing operation and a belt meander learning processing. FIG. 3 shows a steering control in a normal image formation process.

That is, when power is turned on, learning processing of FIG. 1 and FIG. 2 is performed, and the steering control of FIG. 3 is performed according to the learned values and characteristics. The belt meander control of the present invention is as follows.

Firstly, the belt meander characteristic learning processing will be detailed below.

When the rotation of the photosensitive belt is started, the system waits until the TOF711 of the photosensitive belt 701 is detected by the photo-sensor 714 (step S1). When the TOF 711 is detected by the photo-sensor 714, control is started as follows. Starting at this TOF 711, the belt edge sensor 710 detects the belt edge position change as a voltage change. This change is converted into a digital value by an A/D converter in the microcomputer.

Here, the belt edge position is obtained as an average position data for a predetermined small interval. For example, for each 1 msec, 100 samples are averaged. Thus N data items are obtained (steps S2 to S8) until the TOF 711 is detected for the second time.

When the TOF 711 of the photosensitive belt is detected for the second time, the number of belt edge average position data items, i.e., N is already known. Next, for detecting the photosensitive belt skew amount, photosensitive belt average position data items are obtained after the second detection of TOF 711.

After the second belt edge average position data is obtained, the rotation of the photosensitive belt is terminated and calculation correction processing is performed.

Using the belt edge average position data after the first TOF 711 and the second TOF 711, a skew amount is obtained from difference of these two data items (step S10). This difference is divided by the data number N (small intervals) so as to obtain a skew correction amount for each of the small intervals. Using this skew correction amount, skew correction is performed (steps S11 to S13).

In skew correction, the correction amount is increased from the start point (first TOF) toward the end point (second TOF), so that the belt edge average position data of the first start is identical to that of the second start.

Next, using the N correction belt edge position data items of the one belt turn, the average belt edge position is calculated for one turn of the photosensitive belt (step S14), and a difference between the average belt edge position and the target belt edge position is calculated. And this difference deleted from the N belt edge average position data. Thus, the belt edge position data of the belt first turn can be used as a belt edge reference position data for offset correction (step S15).

The offset-corrected belt edge position data for one belt turn becomes belt-inherent fluctuation at the TOF 711 (scratch, stepped seam). This is the learning value and held in the learning value memory (step S16). Thus, the belt meander characteristics learning is completed.

Next, explanation will be given on the belt meander control in the normal image formation process. FIG. 3 is a flowchart of the belt meander control activated when a image data is fed from the host computer, for the image forming process. FIG. 3 is a belt meander control flowchart. This belt meander control flowchart during the image formation process includes an image formation control (such as a paper feed and laser control) so that multi tasks can be performed. Accordingly, when the processing of the belt edge average position data DP(n)is complete, the system return to the main control (not depicted), Before starting the belt meander control, the rotation control (not depicted) detects the rotation reference point detection hole (TOF) and starting at this TOF it is possible to obtain a current belt edge average position data DP (n) for each small intervals the belt one turn (steps S21 and S22).

Moreover in the flowchart of FIG. 3, it is possible to obtain a current belt edge position (belt position data DP (n) for each small interval passed as a current position from the belt rotation control). Simultaneously with this, the belt edge learning data of the current position is read out (step S22), and a deviation (difference) between the belt edge average value and the belt edge learning value of the current position is calculated (step S23). Next, a deviation (difference) between the belt edge average position data of a preceding interval and the learning value of that position is calculated (step S24).

Subsequently, the learning value deviation of the current position and the learning value deviation of the preceding interval are considered. The learning deviation of the current position may be small (1), positively greater (2), or negatively greater (3). Also, the learning value deviation of the current position with the learning value deviation of a preceding interval may be smaller (1), positively greater (2), negatively greater (3). The combination of 3×3 requires to assume at least nine belt traveling states.

For these nine belt traveling states, the meander control is performed according to a change amount between the learning value deviation of the current position and that of the preceding interval (steps S24 and S25).

From the learning value deviation of the current position, a steering change offset constant K is decided for each interval. Simultaneously with this, from the learning value deviation of a preceding interval, if this deviation is out of a predetermined range, a skew correction constant L is determined. According to the steering change of offset constant K and the skew correction constant L, the change pulse number STP of the pulse motor 707 is obtained from the following equation, $$STP=L+2\times K$$

and this STP value is used for rotating the steering motor (steps S26 and S27)

FIG. 4(A), FIG. 4(B), FIG. 4(C) and FIG. 5 shows steering amount control during a belt meander control according to the leaning deviation of a current position and that of a preceding interval.

In this steering amount control, firstly, the learning value deviation of a current position decides a steering change offset constant K (steps S31 to S39). From a difference of the learning value deviation of a preceding interval, if the difference is out of a predetermined value, a skew correction constant L is determined (steps S40 to S51). According to the steering change offset constant K which has been obtained and the skew correction constant L, the change pulse number STP of the pulse motor 707 is obtained as follows:

$$STP=L+2\times K$$

and for this STP value, the motor is rotated (steps S52 to S55).

On the other hand, if the skew amount is within a predetermined value, different operations are performed according to the value K decided by the learning value deviation of the current position. For example, if K is zero, addition is performed until the skew amount exceeds a predetermined skew amount. When the predetermined value is exceeded, the pulse motor 707 is rotated by +1 or −1.

Moreover, even if the skew amount is within a predetermined value, if the learning value deviation is great, it should be corrected. This decides the change pulse number STP of the pulse motor 707 as $$STP=4\times K$$

and the pulse motor is rotated by this STP value (steps S56, S57, and S63 to S65).

As an example of this present embodiment, L and K have parameter values as follows: DK1=−2, DK2=−1, DK3=2, DK4=1, DK5=−6, DK6=−4. DK7=−2, DK8=6, DK9=4, DK10=2. DK11=−1, DK12=1, and DK13=4.

FIG. 6A to FIG. 6E show learning value deviations as an inherent displacement of the belt edge and skew generations viewed from one direction with respect to the desired belt edge position.

For such relationships, the K value in the learning deviation and the L value by the skew amount are assured. This control is converged to almost the leaning value, thus enabling to obtain a stable belt rotation.

It should be noted in the aforementioned embodiment, deviation from the belt reference point is determined five regions and skew change is set in seven regions including a predetermined region. However, the region setting is not to be limited to this but can be divided into smaller regions, which can control rapidly. In this case, K value and the L value are different from the aforementioned embodiment, and the equation for deciding the pulse number of the steering motor is different.

As has been described above, the present invention exhibits merits as follows.

Firstly, the belt deviation amount is detected from the learning amount deviation, i.e., difference of the belt edge current position and the learning value, and a belt skew state is detected from the difference from the learning value deviation of a preceding interval. These two amounts are used to decide the steering motor operation amount. Accordingly, for the belt in any state, it is possible to gradually reduce the steering motor change amount. As a result, meander amount can be suppressed into a small range of plus and minus 20 micrometers.

Secondly, during initializing at power on, the belt is rotated by one or more turn so as to read the scratches or stepped portion of seam as inherent fluctuation, which are used for skew state correction before performing offset correction to the reference point. Thus, the value obtained as a learning value is accurate and this learning is performed each time power is turned on, this eliminate erroneous control due to belt deterioration.

The invention may be embodied in other specific forms without departing from the spirit or essential characteristic thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosure of Japanese Patent Application No. A10-303208 (filed on Oct. $12^{th}$, 1998) including specification, claims, drawings and summary are incorporated herein by reference in its entirety.

What is claimed is:

1. A color printer belt meander control method for detecting a belt edge position of a rotating endless belt and controlling a steering mechanism according to the belt edge position so as to suppress meandering of the rotating endless belt, wherein the rotating endless belt has a rotation reference position mark at which belt edge detection is started for each small interval and all the skew amounts are calculated according a difference between the belt edge position data at the rotation reference position mark for the first time and the belt edge position data at the rotation reference position mark for the second time, and the method further comprising steps of:

dividing the total of the skew amounts by the number of the small intervals so as to calculate a skew correction amount for each small interval;

calculating an average belt edge position for one turn of the belt according to a corrected belt edge position data of each small interval which has been corrected according to the skew correction amount;

calculating a difference between this average belt edge position and a target belt edge position data at the rotation reference position mark;

deleting this difference from the corrected belt edge position data for each small interval to obtain a belt edge learning value; and controlling drive of the steering mechanism according to the belt edge learning value and the belt edge position data detected for each small interval.

2. A color printer belt meander control method as claimed in claim 1, wherein the belt edge position is detected for each small interval with a predetermined sampling cycle and its average value is used as a belt edge position data.

3. A color printer belt meander control method as claimed in claim 1, wherein for an arbitrary small interval, a learning value deviation as a difference between the belt edge learning value and a detected belt edge position data is compared to a learning value deviation of a preceding small interval, and according to the comparison result, the steering mechanism drive is controlled.

4. A color printer belt meander control method as claimed in claim 2, wherein for an arbitrary small interval, a learning value deviation as a difference between the belt edge learning value and a detected belt edge position data is compared to a learning value deviation of a preceding small interval, and according to the comparison result, the steering mechanism drive is controlled.

5. A color printer belt meander control method as claimed in claim 1, wherein the calculation of the belt edge learning value is performed when the color printer is actuated.

6. A color printer belt meander control method as claimed in claim 2, wherein the calculation of the belt edge learning value is performed when the color printer is actuated.

7. A color printer belt meander control method as claimed in claim 3, wherein the calculation of the belt edge learning value is performed when the color printer is actuated.

8. A color printer belt meander control method as claimed in claim 4, wherein the calculation of the belt edge learning value is performed when the color printer is actuated.

9. A color printer belt meander control apparatus comprising a steering control unit for detecting a belt edge position of a rotating endless belt and controlling a steering mechanism according to the belt edge position so as to suppress meandering of the rotating endless belt, wherein the rotating endless belt has a rotation reference position mark at which belt edge detection is started for each small interval and all the skew amounts are calculated according a difference between the belt edge position data at the rotation reference position mark for the first time and the belt edge position data at the rotation reference position mark for the second time, and the control unit further performs:

dividing the total of the skew amounts by the number of the small intervals so as to calculate a skew correction amount for each small interval;

calculating an average belt edge position for one turn of the belt according to a corrected belt edge position data of each small interval which has been corrected according to the skew correction amount;

calculating a difference between this average belt edge position and a target belt edge position data at the rotation reference position mark;

deleting this difference from the corrected belt edge position data for each small interval so as to offset correct the belt edge position for each small interval to obtain a belt edge learning value; and controlling drive of the steering mechanism according to the belt edge learning value and the belt edge position data detected for each small interval.

10. A color printer belt meander control apparatus as claimed in claim 9, wherein the control unit detects the belt edge position for each small interval with a predetermined sampling cycle and its average value is used as a belt edge position data.

11. A color printer belt meander control apparatus as claimed in claim 10, wherein for an arbitrary small interval, the control unit compares a learning value deviation as a difference between the belt edge learning value and a detected belt edge position data to a learning value deviation of a preceding small interval, and according to the comparison result, the control unit controls the steering mechanism drive.

12. A color printer belt meander control apparatus as claimed in claim 9, wherein the control unit performs belt edge learning value calculation upon reception of a color printer start signal.

13. A color printer belt meander control apparatus as claimed in claim 10, wherein the control unit performs belt edge learning value calculation upon reception of a color printer start signal.

14. A color printer belt meander control apparatus as claimed in claim 11, wherein the control unit performs belt edge learning value calculation upon reception of a color printer start signal.

15. A color printer belt meander control apparatus as claimed in claim 9, wherein the control unit performs belt edge learning value calculation upon reception of an initialization signal at start of the color printer.

16. A color printer belt meander control apparatus as claimed in claim 10, wherein the control unit performs belt edge learning value calculation upon reception of an initialization signal at start of the color printer.

17. A color printer belt meander control apparatus as claimed in claim 11, wherein the control unit performs belt edge learning value calculation upon reception of an initialization signal at start of the color printer.

* * * * *